US008993938B2

(12) United States Patent
Hall, Jr. et al.

(10) Patent No.: US 8,993,938 B2
(45) Date of Patent: Mar. 31, 2015

(54) HEATER WITH A LEVEL SWITCH SAFETY MECHANISM

(71) Applicants: Edwin L Hall, Jr., Amelia Island, FL (US); Hampton Hollis Tanner, Amelia Island, FL (US)

(72) Inventors: Edwin L Hall, Jr., Amelia Island, FL (US); Hampton Hollis Tanner, Amelia Island, FL (US)

(73) Assignee: Well Traveled Imports, Inc., Amelia Island, FL (US)

( * ) Notice: Subject to any disclaimer, the term of this patent is extended or adjusted under 35 U.S.C. 154(b) by 210 days.

(21) Appl. No.: 13/897,347

(22) Filed: May 17, 2013

(65) Prior Publication Data

US 2013/0287375 A1 Oct. 31, 2013

Related U.S. Application Data

(63) Continuation-in-part of application No. 12/726,321, filed on Mar. 17, 2010, now Pat. No. 8,461,494.

(51) Int. Cl.

| | |
|---|---|
| ***H05B 3/06*** | (2006.01) |
| ***F24D 19/10*** | (2006.01) |
| ***H01H 35/02*** | (2006.01) |
| ***F24C 7/08*** | (2006.01) |
| ***F24C 7/10*** | (2006.01) |
| ***H05B 1/02*** | (2006.01) |
| ***F24C 1/08*** | (2006.01) |
| ***F24H 9/20*** | (2006.01) |
| *F24H 3/00* | (2006.01) |

(52) U.S. Cl.

CPC ..... *F24D 19/1096* (2013.01); *H01H 35/027* (2013.01); *F24C 7/081* (2013.01); *F24C 7/105* (2013.01); *H05B 1/0277* (2013.01); *H05B 2203/032* (2013.01); *F24C 1/08* (2013.01); *F24H 9/2071* (2013.01); *F24H 3/002* (2013.01)

USPC ..... 219/536

(58) Field of Classification Search

CPC .. F24H 9/2071; F24H 3/002; H05B 2203/032

USPC ..... 219/536–540

See application file for complete search history.

(56) References Cited

U.S. PATENT DOCUMENTS

| | | | |
|---|---|---|---|
| 5,841,944 | A | 11/1998 | Hutchinson et al. |
| 6,082,693 | A | 7/2000 | Benson et al. |
| 6,559,396 | B1 | 5/2003 | Chou |
| 7,471,883 | B2 | 12/2008 | Seutter et al. |
| 2009/0032076 | A1 | 2/2009 | Boldsen |
| 2009/0283606 | A1 | 11/2009 | Terrell et al. |

OTHER PUBLICATIONS

International Searching Authority PCT Invitation to Pay Additional Fees and, where applicable, protest fee, Aug. 1, 2014, by Authorized Officer Matias Garraz, Gruno.

*Primary Examiner* — Cuong Q Nguyen

(74) *Attorney, Agent, or Firm* — Lau & Associates, LLC.

(57) ABSTRACT

An indoor or outdoor heater with a safety bar, a tiltable heater head, a power controlling and power limiting device serving as safety mechanisms.

35 Claims, 18 Drawing Sheets

HEATER WITH A LEVEL SWITCH SAFETY MECHANISM

This application hereby claims the priority of U.S. patent application Ser. No. 12/726,321 filed on Mar. 17, 2010, now allowed but not yet issued, which application claims the priority date under 35 U.S.C. 119(e) of U.S. Provisional Application No. 61/202,616 filed on Mar. 18, 2009.

FIELD OF INVENTION

The invention relates generally to a heating device.

BACKGROUND OF THE INVENTION

Freestanding Liquid Propane gas (LPG) heaters are used for heating patio surroundings. Though popular, they have quite a number of limitations. First, conventional LPG patio heaters do not operate with an optimal efficiency to adequately heat a sizable area. they have approximately 40% heat energy conversion rate. Second, in the presence of wind, the efficiency of LPG patio heater is further reduced. Third, LPG patio heaters need to be refilled and the frequency of which depends on the extent of usage. The cost to operate an LPG patio heater is approximately eight times greater than operating a Short-Wave-Infrared (SWI) heater. Fourth, conventional LPG patio heaters tend to be rather bulky and therefore difficult to relocate due to its requirement to house a large and heavy LPG tank. Fifth, limited by the requirement to house a large and heavy LPG tank, many aesthetically more appealing designs cannot be implemented. Sixth, due to the requirement to dissipate exhaust fumes, LPG heaters can only be safely operated in an outdoor environment. This substantially reduces the utility opportunities of LPG heaters.

Many existing SWI heater systems are wall mounted SWI heaters, or tripod mounted SWI heaters. Wall mounted SWI heaters can only be used where they are mounted. Thus, they can serve limited purposes. Many SWI heaters that are not wall-mounted are supported by simple tripod stands. Tripod stands are obtrusive and can be accidentally tripped thus create both a safety hazard and a fire hazard.

SWI heaters have a heat energy conversion rate of approximately 92% and can be used indoors or outdoors. SWI heaters can be directly aimed toward an object to be heated whereas LPG heaters are designed to heat the ambient environment surrounding the heaters and whatever objects within the ambient environment heating zone. However, this means the object to be heated must be in the path of the infrared light waves. Wall mounted and tripod mounted units are often not capable of being in a close enough proximity to the objects to be heated.

SWI heaters rely on electricity as its energy source. Most home circuits have a 15 ampere limitation and commercial offices may have a 20 ampere limitation. With 110-120 VAC power supplied in average households, SWI heaters cannot consume a power rating exceeding 1650-1800 watts. Given voltage fluctuations do occurred for various reasons, a theoretical limit of 1650 watt is possible but a more prudent limit of 1500 watts may be more appropriate to provide added safety precautions. Limiting the maximum wattage to less than 1500 watts limits the utility value of SWI heaters. However, allowing SWI heaters to function at the prudent maximum residential power rating of 1500 watts might raise some legitimate safety concerns. To address these concerns, the present invention provides a number of safety mechanisms to eliminate the safety concerns while allowing SWI heaters to function at the prudent maximum power ratings of 1500 watts for residential use.

Of course the present invention may be used in commercial settings and industrial settings. If so, the maximum power consumption may be raised far above that for residential use. The safety mechanisms addressed in the present invention would become even more important.

OBJECTION OF THE INVENTION

It is a first object of the present invention to provide a heater without any exhaust fumes thus usable either indoors or outdoors.

It is a second object of the present invention to provide a support assembly with wheels for ease of relocation convenience.

It is a third object of the present invention to provide a heater head with a predetermined degrees of rotational freedom so heat can be directed to a desired area.

It is a fourth object of the present invention to provide a safety bracket so that a minimum distance may be maintained between the heater head and an adjacent article.

It is a fifth object of the present invention to provide a thermocouple so that the heater head may be turned off if the thermocouple senses a temperature level reaching a threshold dangerous level.

It is a sixth object of the present invention to provide a heater much more efficient to use than conventional LPG heaters.

It is a seventh object of the present invention to provide an extendable safety bar.

It is an eighth object of the present invention to provide an extendable utility bar with distance markings for usage convenience.

It is a ninth object of the present invention to deviate from the large and bulky bottom design theme due to the requirement to house a large and bulky LPG tank.

It is a tenth object of the present invention to use a continuous energy supply source so that exchanging for a resupply tank of energy source is not needed.

It is an eleventh object of the present invention to use an energy source that is more efficient in heat generation than a LPG energy source.

It is a twelfth object of the present invention to promote safety by utilizing a level safety switch mechanism.

Other objects of the present invention would become self evident upon a review of the following written specification, drawings and claims.

DETAILED DESCRIPTION OF THE INVENTION

Figure 1:
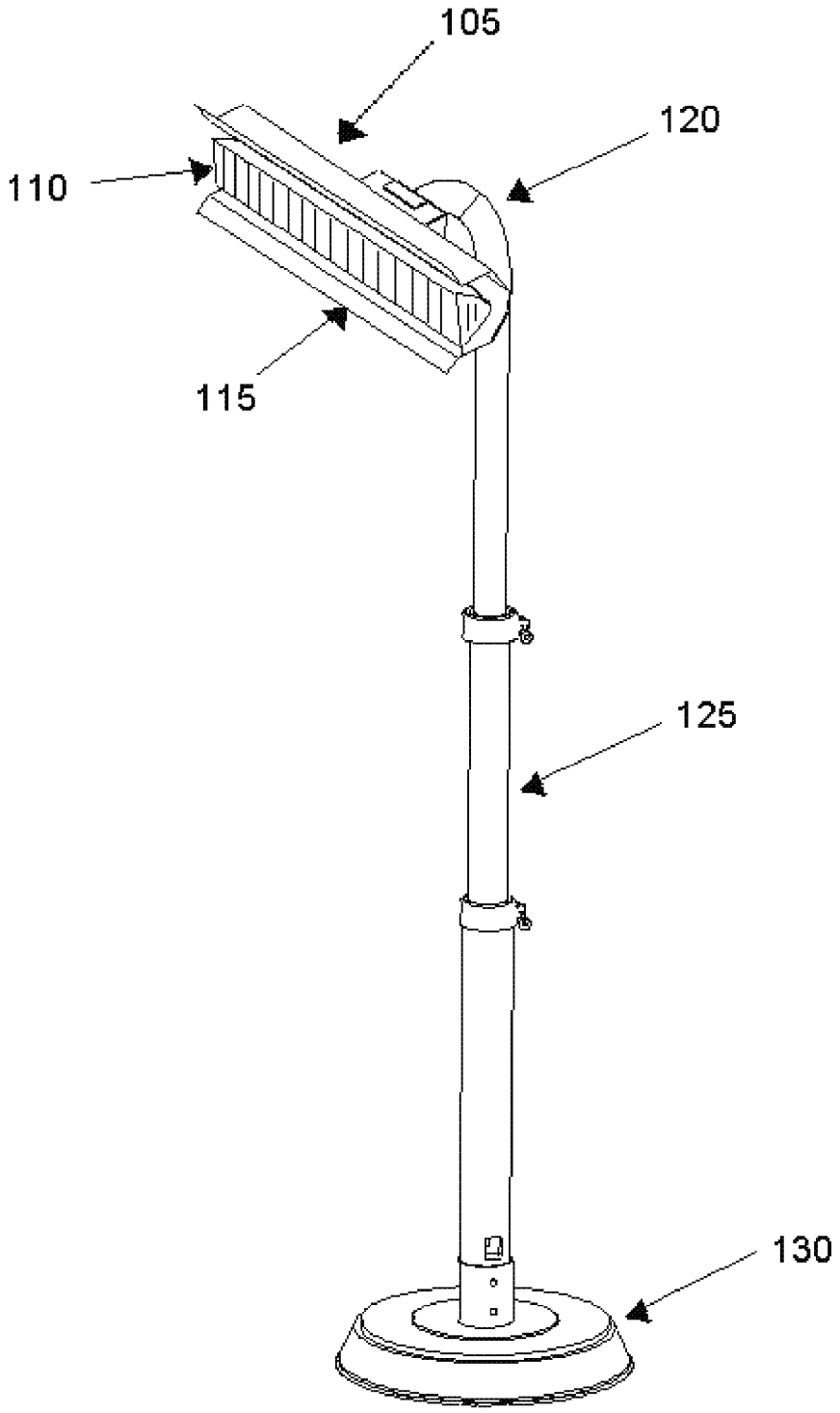
FIG. 1 illustrates a diagram of a patio heating device in accordance with an embodiment of the present invention.

Before describing in detail embodiments by way of examples that are in accordance with the present invention, it should be observed that the embodiments reside primarily in combinations of method steps and apparatus components related to a system of short-wave-infrared (SWI) heater with support assembly. Accordingly, the apparatus components and method steps have been represented where appropriate by conventional symbols in the drawings, showing only those specific details that are pertinent to the understanding of the present invention so as not to obscure the disclosure with details that will be readily apparent to those of ordinary skill in the art having the benefit of the description given herein. Thus, for simplicity and clarity of illustrations, common and well-understood elements that are useful or necessary in a commercially feasible embodiment may not be depicted in order to facilitate a less obstructed view of these various embodiments. Also, a device or structure that is "configured" in a certain way is configured in at least that way, but may also be configured in ways that are not listed.

It will be appreciated that embodiments by way of examples of the present invention described herein may comprise of one or more conventional processors with unique stored program instructions that control the one or more processors to implement, in conjunction with certain non-processor circuits, some, most, or all of the functions of the system of short-wave-infrared (SWI) heater with support assembly. The non-processor circuits may include, but are not limited to, clock circuits, power source circuits, and user input devices. As such, these functions may be interpreted as steps of heating a patio using a short-wave-infrared (SWI) heater with support assembly. Alternatively, some or all functions could be implemented by a machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Generally speaking, pursuant to the various embodiments, the present invention discloses a system of short-wave-infrared (SWI) heater with support assembly. The support assembly, for example, comprises a mounting pole and an angled pole section providing an offset to the SWI heater.

Even though the present invention provides numerous examples of SWI heaters, a person of ordinary skill in the art readily recognizes that the safety mechanism disclosed herein would eliminate safety concerns in heater heads using other means of generating heat, including but not limited to ceramic, filament, liquid propane gas, etc.

Referring to FIG. 1, a diagram of a heating device is shown in accordance with an embodiment of the present invention. The heating device comprises a head unit 105. Head unit 105 may comprise a heating unit 110 such as a SWI heater. Head unit 105 can be used in a manner similar to a conventional LPG patio heater. An embodiment of the present invention, heating unit 110 is a SWI heater and an adjoining assembly that can be analogous to conventional LPG patio heaters but with additional features. The present invention enables heating more effectively, more directly and more economically than a conventional LPG heater.

Head unit 105 can further comprise a shield 115 surrounding heating unit 110 to protect heating unit 110 from, say, light rain or morning dew, bugs, etc. Shield 115 can be made of aluminum or any suitable man-made or natural material.

An offset assembly 120 is coupled to head unit 105 to provide an offset to head unit 105. Those skilled in the art will appreciate that offset assembly 120 allows head unit 105, which comprises heating unit 110, to be placed in close proximity to the area being heated without being obtrusive. Offset assembly 120, for example, comprises an angled pole section which ensures that head unit 105 is substantially away or 'offset' from the rest of the patio heating device. In an embodiment of the present invention, head unit 105 is mounted on offset assembly 120 via a mounting device. The mounting device allows a user to adjust the position of head unit 105.

A mounting pole 125 is releasably coupled to offset assembly 120 for easy portability and storage. Mounting pole 125 can be, for example, a telescoping pole or can comprise a plurality of sections such that the sections can be fastened or screwed together. Height of mounting pole 125 is adjustable by rearranging height placement of the plurality of sections.

Furthermore, a base unit 130 is coupled to mounting pole 125. Base unit 130, for example, can comprise a plurality of wheels that also enable easy portability and storage. In an embodiment of the present invention, a weighted body, for example, a weighted disc, is attached to the base unit 130. Those skilled in the art would realize that the weighted body can provide stability to the patio heating device.

Head unit 105, for example, comprises a shield 115, mounting pole 125 and base unit 130 may be made of powder-coated steel, stainless steel or other suitable material which is durable, weather proof and economical.

Figure 2:
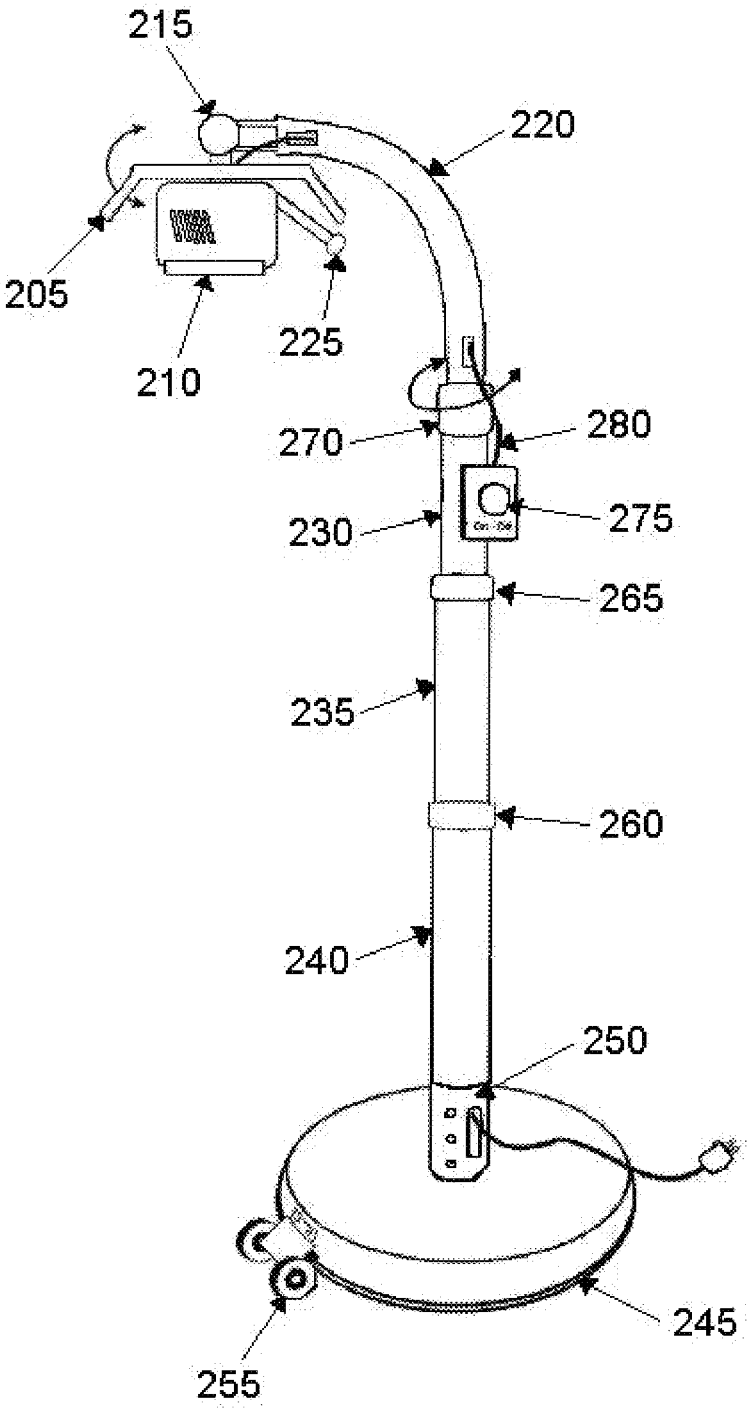
FIG. 2 illustrates a side view of a short-wave-infrared (SWI) heater support assembly in accordance with an embodiment of the present invention.

Turning now to FIG. 2, a side view of a short-wave-infrared (SWI) heater with support assembly is shown in accordance with an embodiment of the present invention. A shield 205 is used to house a SWI heater 210. Shield 205 can be made of aluminum or any other suitable material. Shield 205 can provide SWI heater 210 protection from light rain, morning dew, etc. Shield 205 together with SWI heater 210 forms head unit 105 of FIG. 1. Those skilled in the art shall realize that the shape of shield 205 is not restricted to the one shown in FIG. 2 and can be of any shape, provided it protects SWI heater 210.

In an embodiment of the present invention, shield 205 can be mounted on angled pole section 220 via a rotating collar mount 215, for example, a 45-degree rotating collar mount. Rotating collar mount 215 allows head unit 105, to be rotated about rotating collar mount 215 so that a user can adjust head unit 105 to direct the heat towards an area to be heated. Moreover, angled pole section 220 can have a 110 to 120 degrees bend to provide an offset to head unit 105. Those of ordinary skill in the art shall realize that having head unit 105 offset from rest of the short-wave-infrared (SWI) heater support assembly allows head unit 105 to heat from overhead instead of directly adjacent to, for example from the side of, the area to be heated.

An embodiment of the present invention also comprises a positioning bar 225 coupled to SWI heater 210. Positioning bar 225 can allow the user to adjust the position of SWI heater 210 without having to touch SWI heater 210, which can get hot while SWI heater 210 is operating.

The mounting pole shown in the embodiment depicted in FIG. 2 comprises three sections, an uppermost section 230, a middle section 235 and a bottommost section 240, in addition to angled pole section 220. The three sections enable the mounting pole to be adjustable in height, for example the three sections can be telescoping or can be screwed together. Angled pole section 220 is coupled to the uppermost section 230. The mounting pole, for example a telescoping pole, allows the SWI heater support assembly to be compact for shipping and can minimize the height of the SWI heater support assembly for easy storage. When the mounting pole is retracted, the height of head unit 105, in accordance with an embodiment of the present invention, may be reduced by approximately 30 inches to approximately 64 inches. In accordance with an embodiment of the present invention, when the sections are substantially fully extended, head unit 105 has a height of approximately 94 inches. This height allows the head unit 105 to be high enough to provide heat from overhead. Those skilled in the art will realize that other dimensions for the mounting pole can also be used and is within the scope of the present invention.

Bottommost section 240 of the mounting pole is mounted on a base unit 245. Base unit 245 can be circular in shape. However, those skilled in the art will realize that different dimensions and shapes can also be used for base unit 245 and are within the scope of the present invention.

In one embodiment of the present invention, a weighted body, like a weighted disc, providing stability to the SWI heater support assembly is mounted on the underside of base unit 245. Those skilled in the art will realize that the weighted body can provide stability for the SWI heater support assembly thereby compensating for the weight of SWI heater 210 in head unit 105, which is offset from the center of base unit 245 and mounting pole. A steel flange 250 can be mounted to the top of base unit 245. Bottommost section 240 of the mounting pole may be fastened to steel flange 250. Also, a plurality of wheels 255 can be attached to base unit 245 enabling the SWI heater support assembly to be easily moved.

In accordance with the embodiments of the present invention, a tightening collar 260 is affixed to the upper portion of bottommost section 240. Middle section 235 can be inserted in tightening collar 260 and affixed to bottommost section 240. Another tightening collar 265 can be used to attach uppermost section 230 to middle section 235. Those skilled in the art will realize that if the mounting pole is desired to be telescoping in nature, uppermost section 230 may need to be smaller in diameter than middle section 235 and middle section 235 may need to be smaller in diameter than bottommost section 240. An attachment, coupling collar 270 can be mounted on the top of uppermost section 230 so that angled pole section 220 can be inserted in attachment coupling collar 270. Those skilled in the art will realize that attachment coupling collar 270 can be mounted on top of uppermost section 230 such that angled pole section 220 can be freely rotated about attachment coupling collar 270, for example, a 360 degree rotation of angled pole section 220 is possible. Angled pole section 220 can bend at an approximate 110 to 120 degrees angle or may be otherwise angled relative to uppermost section 230, middle section 235 and bottommost section 240.

In an embodiment of the present invention, a power switch coupled to a dimmer 275 are mounted to the mounting pole with a power cord 280 running to head unit 105 and providing power to SWI heater 210. Power switch coupled to a dimmer 275 can allow a user to turn SWI heater 210 on and off and to adjust the heat output.

Figure 3:
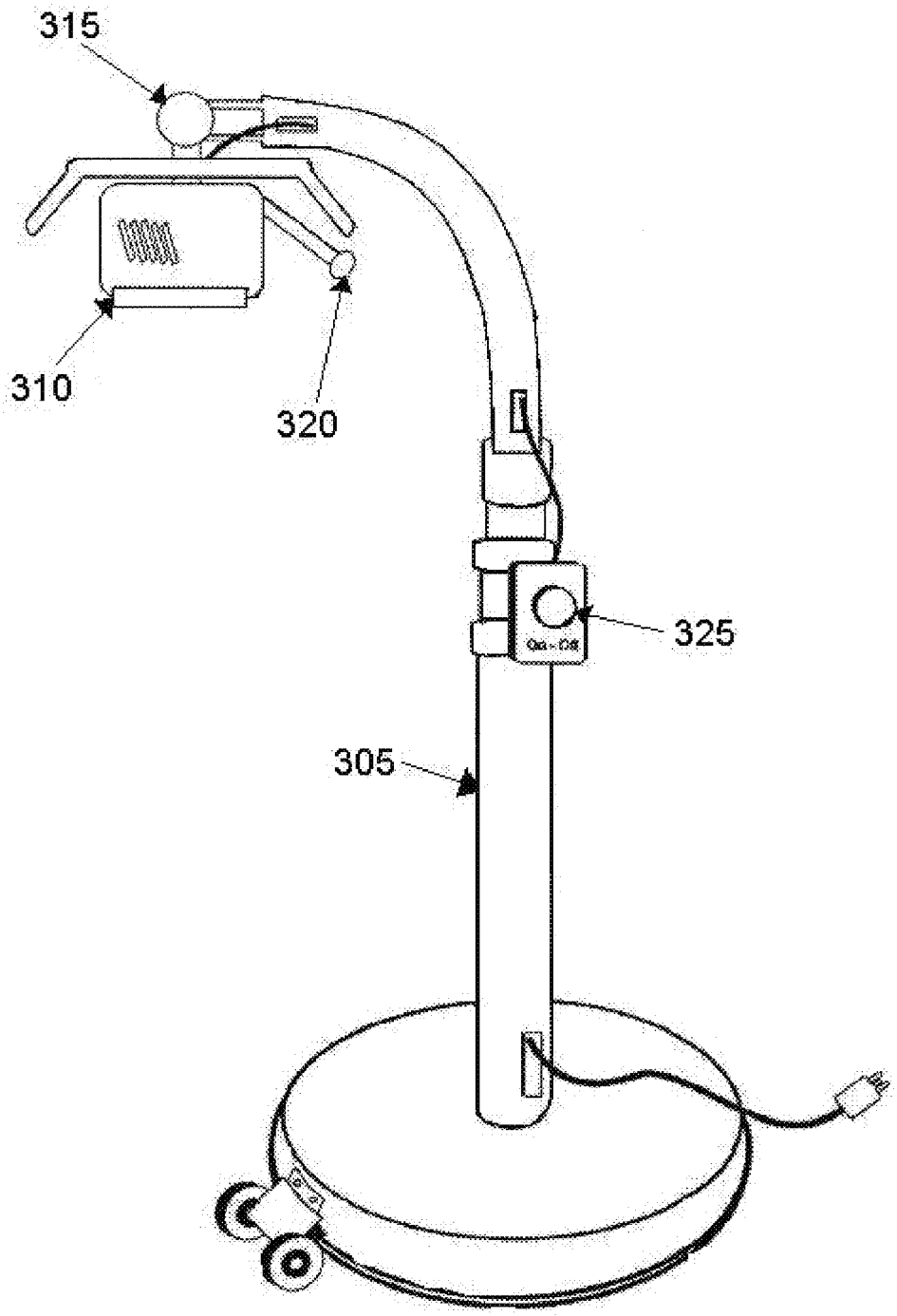
FIG. 3 illustrates an exemplary embodiment of a retracted short-wave-infrared (SWI) heater support assembly in accordance with an embodiment of the present invention.

Turning now to FIG. 3, an exemplary embodiment of a retracted short-wave-infrared (SWI) heater support assembly is shown in accordance with an embodiment of the present invention. Uppermost section 230 and middle section 235 of the mounting pole of FIG. 2 are retracted to obtain a mounting pole 305 with a decreased height. Therefore, the height of a SWI heater 310 can be adjusted by virtue of the present embodiment. Moreover, the position of SWI heater 310 can be changed using a rotating collar mount 315 and a positioning bar 320. For example, if a user is sitting on a chair and wishes to have SWI heater 310 be directed towards him from the side, mounting pole 305 can be retracted and adjusted accordingly as depicted in the present embodiment and rotating collar mount 315 and positioning bar 320 can be adjusted according to the user's comfort. Also, the heat output of SWI heater 310 can be adjusted using a power switch coupled to a dimmer 325.

Therefore, the embodiments of the present invention relate to the SWI heater and support assembly with an offset mounting pole. Such a heater can solve the problems of a conventional SWI heater support assembly, for example a tripod mounted unit which falls over easily, by making the SWI heater a free standing stable unit with an offset design. This design allows a user to place the SWI heater immediately above or adjacent to the objects to be heated without the SWI heater being obtrusive. More specifically, the offset design of the SWI heater support assembly allows head unit 105 to overhang the area to be heated without base unit 245 and the mounting pole of the SWI heater support assembly needing to be placed in the space to be heated.

Figure 4:
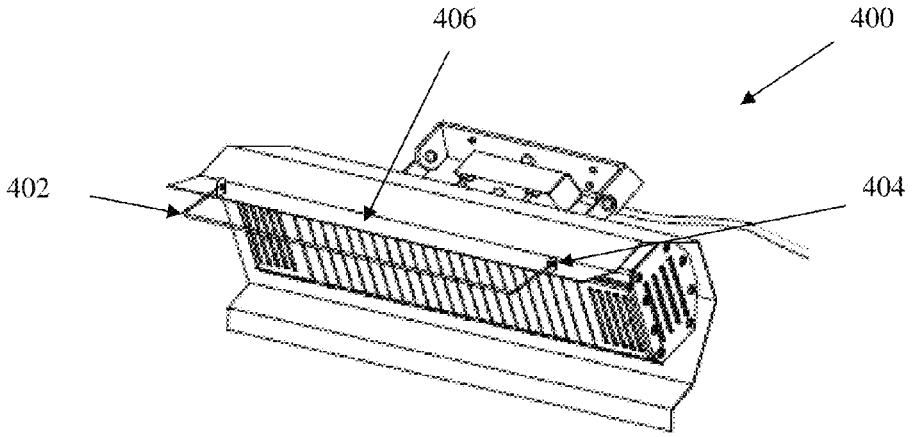
FIG. 4 illustrates a first alternative embodiment of the heater head with a safety guard.

FIG. 4 shows an alternative embodiment of a heater head 400. This is a new generation of heater head with a higher power rating than those already in the industry. Because of its higher power rating, new safety features are introduced. As shown, a safety bracket 402 is added. This safety bracket is attached to the heater head 400 by inserting a pair of end hooks of the safety bracket 402 into a pair of hook receiving taps 404. The safety bracket is rotatable. When needed, the safety bracket can be rotated outward to prevent any adjacent article from reaching a front surface of the heater head 400 where the temperature is the hottest and where it is most capable of igniting the article. When not in used, the safety bracket can be rotated inward to rest on top of heat shield 406. An advantage of this safety bracket is that it has the least amount of aesthetics disturbance when the safety bracket 402 is rotated inward. A disadvantage associated with this safety bracket is that it serves as a part time safety device only when the safety bracket 402 is rotated outward. An ideal safety device provides full time protection.

Figure 5:
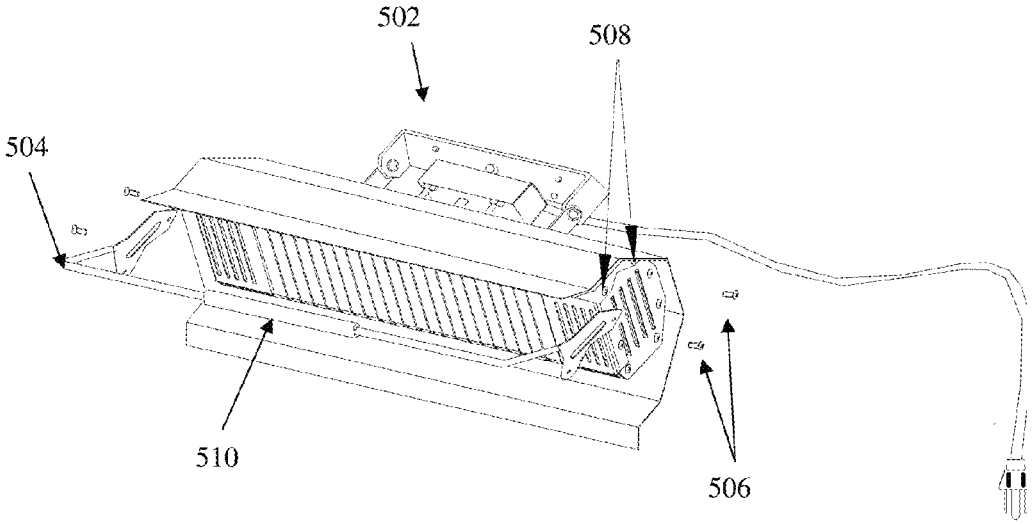
FIG. 5 illustrates a second alternative embodiment of the heater head with a safety guard.

FIG. 5 is another alternative heater head 502 where a full time dedicated safety bracket 504 is shown. Safety bracket 504 is permanently attached to the heater head 502 by fastening a set of screws 506 into a set of pre-drilled receiving holes 508 on both sides of the heater head 502. As reliability of any safety device is of utmost importance, the safety bracket 504 is made of a metallic material thus is durable for the useful life of the safety bracket. An unintended problem associated with using a metallic material for the safety bracket is that it tends to become hot after prolong use of the heater head 502 and becomes too hot to the touch. Therefore, in addition to the safety bracket, there is also a burn-safe heat insulator 510 surrounding a middle front portion of the safety bracket 504. By way of an example, this heat insulator 510 only insulates part of the metallic safety bracket 504. It is of course possible to make the heat insulator 510 to cover more area or even the entire metallic safety bracket 504. However, in this example, only part of the safety bracket is covered to maintain the metallic aesthetic appeal of the heater head. This heat insulator 510 serves several purposes. The first and foremost purpose is to provide a part of the safety bracket that is safe to the touch for people who use heaters under different circumstances and for different purposes. The second purpose is to use the safety bracket 504 as a handle bar upon relocation of the heater. The third purpose is to use the safety bracket 504 as a handle to rotate the tilting angle of the heater head. This safety bracket is non-rotatable thus permanently protrudes in front of the front surface of the heater 502. It ensures a minimum distance is always kept between any adjacent article and the front of the heater head 502 on a full time basis.

Figure 6A:
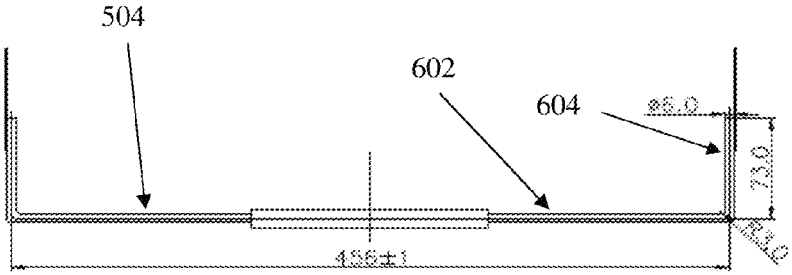
FIG. 6A illustrates a top view of a safety guard of the second alternative embodiment of the heater head.

FIG. 6A shows a top view of safety bracket 504 with a front bar 602 and two side bars 604 including therewith a number of dimensions. These dimensions are merely suggestive and the invention can be practiced with endless amount of dimension variations thus they should not be construed as restrictive.

Figure 6B:
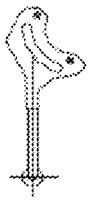
FIG. 6*b* illustrates a side view of a safety guard of the second alternative embodiment of the heater head.

FIG. 6B shows a side view of safety bracket 504.

Figure 7:
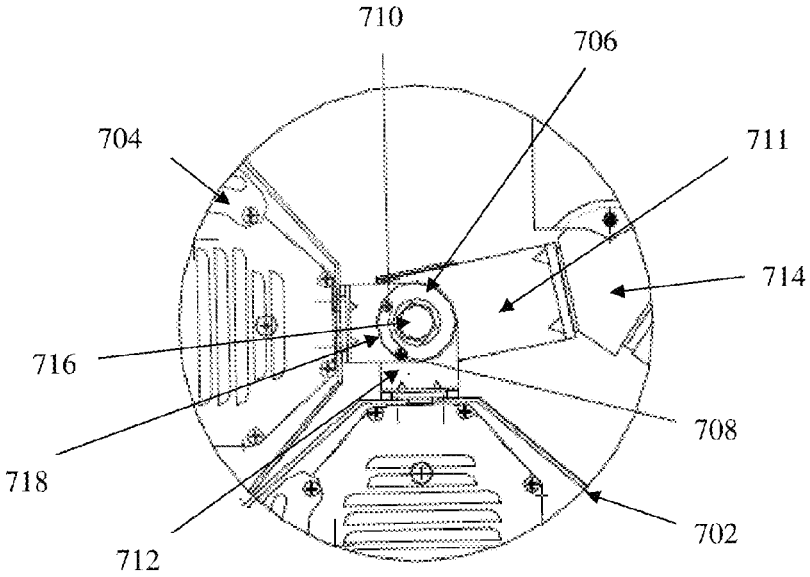
FIG. 7 illustrates a side view showing how a heater is mounted to a support assembly and the presence of a rotatable angle limiter.

FIG. 7 shows that a heater head has a 90 degrees freedom of rotation when fully installed onto a support assembly and put in actual use. To provide a reference perspective, 0 degree designates a front surface of the heater head is completely facing downward as shown in position 702. 90 degrees designate a front surface of the heater head is completely facing outward as shown in position 704. As heat rises, therefore it is unnecessary for the heater head to face upward. However, if necessary, the number of degrees of rotational freedom can of course be increased beyond 90 degrees.

This 90 degrees freedom of rotation is made possible by a rotation angle limiter 706 having a cut-out portion 718. The cut-out portion 718 provides the possible angles of rotation anywhere between 0 to 90 degrees. Position 708 shows the 0 degree point where the heater head is facing downward and position 710 shows the 90 degree point where the heater head is facing away.

The heater head is installed to the support assembly by installing one end of a mounting bracket 711 to a pole coupler 714 of the support assembly and installing another end of the mounting bracket 711 to a pair of receivers 712. The mounting bracket 711 is installed to the pair of receivers 712 by nuts and bolts as represented by 716.

The rotation angle limiter 706 and the associated cut out portion 718 could be a part of either the mounting bracket 711 or a part of receivers 712. Whatever degree selected between 0 and 90 degrees is held in place by friction between the surfaces of the mounting bracket 711 and the surfaces of the pair of receivers 712. Of course, any frictional force between the surfaces of the mounting bracket 711 and the pair of receivers 712 is generated by the fastening force of nuts and bolts 716.

Figure 8:
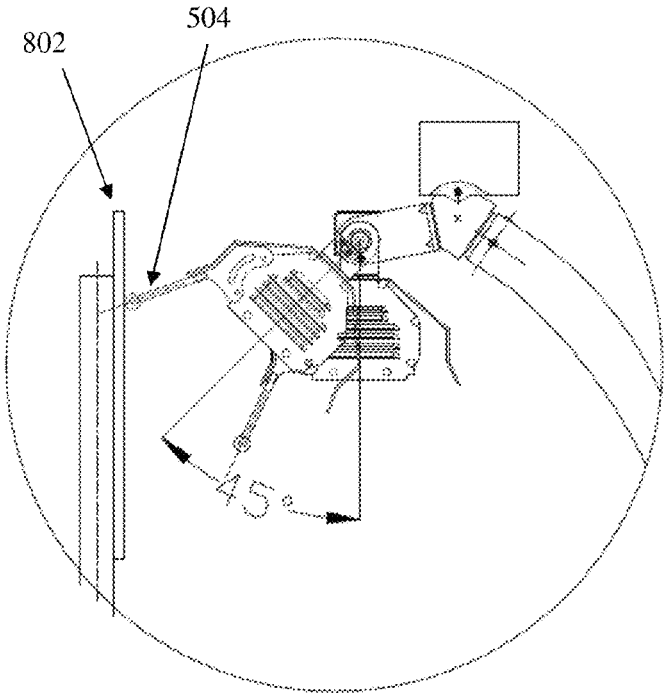
FIG. 8 illustrates a side view of how a safety guard maintains a minimum distance between a heater and an adjacent article.

FIG. 8 shows by way of an example that a heating head is held in place at the 45 degree position and the safety bracket 504 maintains a minimum distance between a front surface of the heater head and an adjacent article 802.

Figure 9:
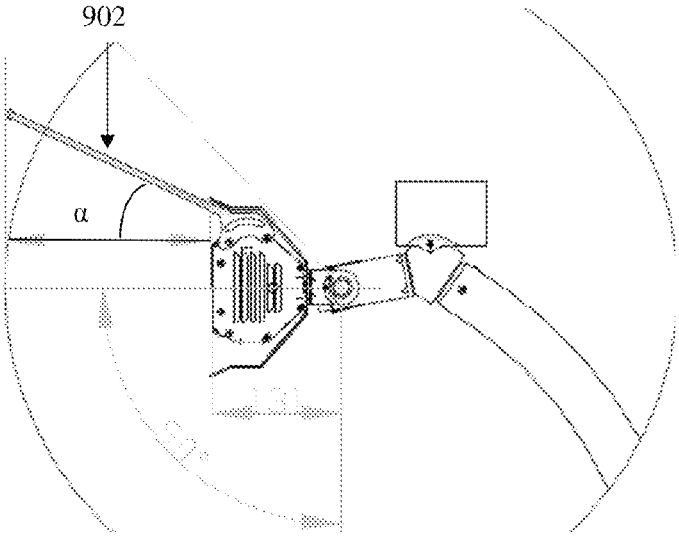
FIG. 9 illustrates a side view of how an alternative and longer safety guard may be installed on a heater.

FIG. 9 shows by way of an example a safety bracket 902 that is longer than safety bracket 504. As it is quite apparent, the longer is the safety bracket, the longer is the minimum distance the safety bracket keeps an adjacent article away from a front surface of the heater head. A top view of the safety bracket 902 is very much the same as that shown in 6A deviating therefrom in that the side lengths are longer.

Figure 10:
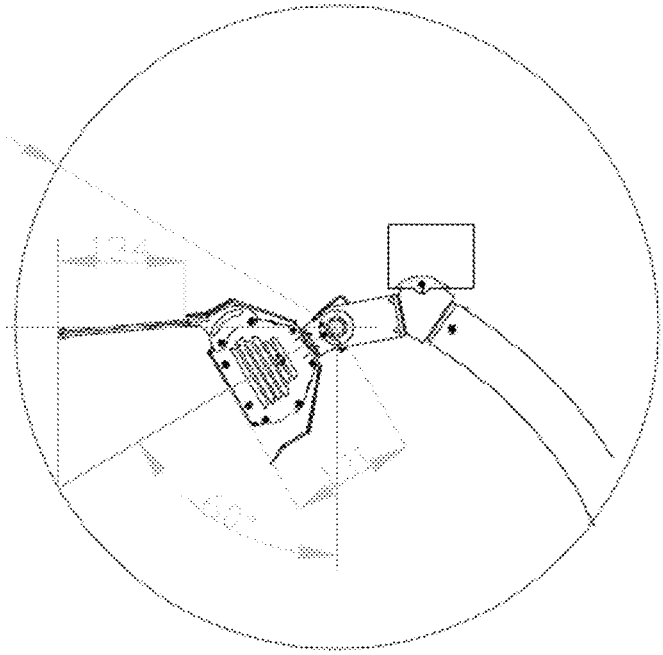
FIG. 10 illustrates a side view of how the alternative and longer safety guard maintains a minimum distance between a heater and an adjacent article while the heater emits heat to the article at a downward angle.

As also shown in FIG. 9, safety bracket 902 is not perpendicular to the front surface of the heater head. An angle $\alpha$ exists between an imaginary line perpendicular to the front surface of the heater head and the safety bracket 902. The purpose of this angle is to maintain a blowing angle between the heater head and the adjacent article when a minimum distance is kept in-between as shown by way of an example in FIG. 10.

Figure 11:
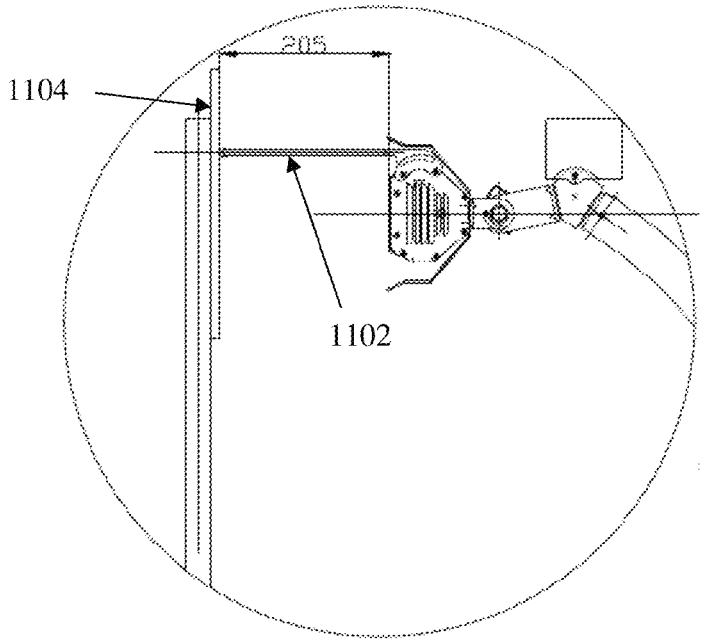
FIG. 11 illustrates a side view of another alternative safety guard which extends perpendicular to an article and the heater head emits heat directly to the article instead of at a downward angle.

FIG. 11 shows an alternative embodiment where a safety bracket 1102 is perpendicular to a front surface of a heater head. The purpose is to maintain a direct heat blow to an adjacent article 1104 that is a fixed distance away from the heater head. While the blowing angle may be of limited interest to residential users, it is foreseeable that the present invention may be of great utility value for commercial users. For example, for a controlled curing of animal hides in the leather goods industry, for a controlled curing of paints in a body shop, for making dried food in a food factory and the possibilities are limitless.

Figures 12A, 12B:
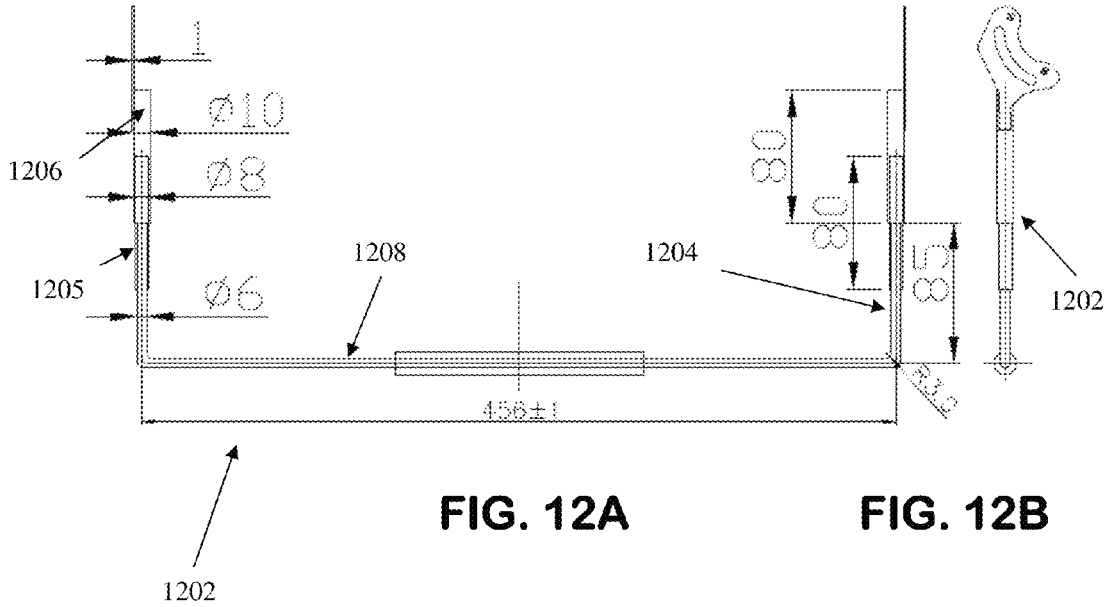
FIG. 12A illustrates a top view of an adjustable safety guard of a heater head.
FIG. 12B illustrates a side view of an adjustable safety guard of a heater head.

It is foreseeable that a commercial user might be interested in the present invention in addition to the safety purpose. For specialized users, FIG. 12A shows a top view of an extendible safety/utility bracket 1202. A side view of the same extendible safety/utility bracket 1202 as shown by way of an example in FIG. 12B. As shown, the extension feature is achieved by a telescopic design where a pair of small diameter side tubes 1204 maybe inserted into a pair of medium diameter side tubes 1205 and the pair of medium diameter side tubes 1205 maybe inserted into a pair of large diameter side tubes 1206. The exact distance the front bar 1208 is extended can be measured by a set of linear demarcations representatively shown as dash lines on each pair of side tubes 1204, 1205 and 1206 in FIG. 12A and FIG. 12B.

A number of dimensions are given in the drawings but they are merely examples and should not be construed as restrictive. The dimensions can of course be changed to suit whatever application requirements.

Figure 13:
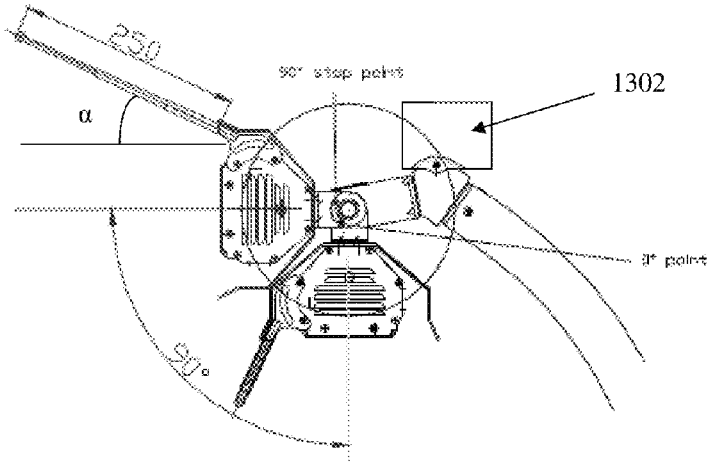
FIG. 13 illustrates a side view of the adjustable safety guard that is installed on a heater head which has a 90 degrees of rotational freedom along an axle on the support assembly.

Each alternative embodiment as concurrently discussed may incorporate therewith features previously discussed thus each feature is not redundantly explained. FIG. 13 shows by way of an example an extendible safety/utility bracket that incorporates many features already explained in the discussion of prior embodiments. The angle $\alpha$ of the safety/utility bracket may include 0 degrees thus could be perpendicular to the front surface of the heater head.

Figure 14A:
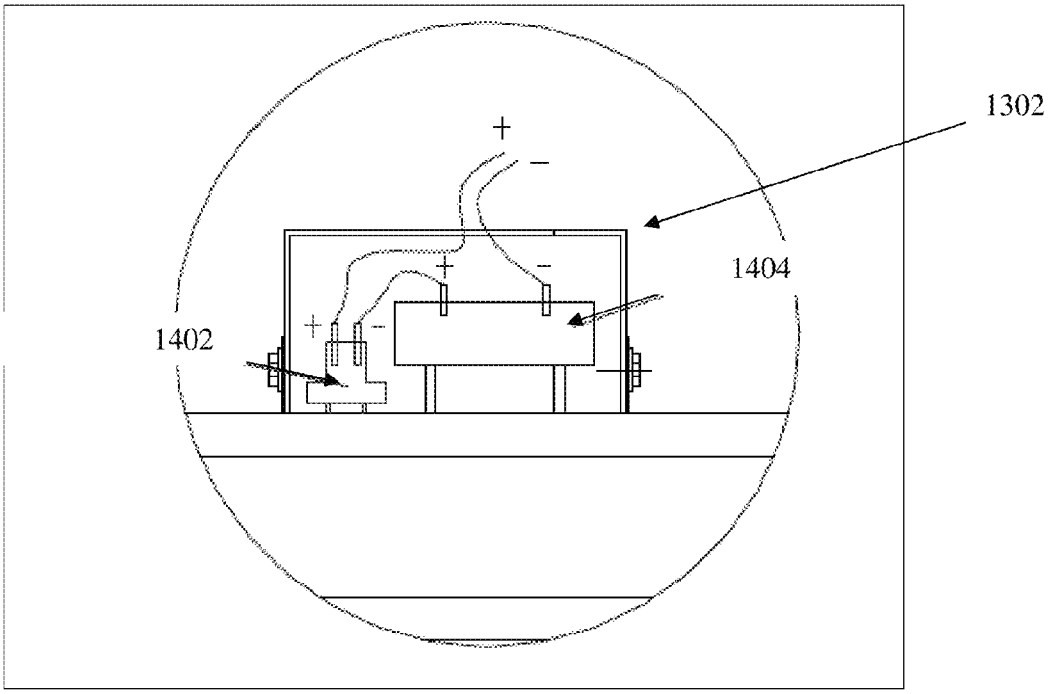
FIG. 14A illustrates a circuit diagram of a thermocouple device which opens an otherwise closed circuit when a predetermined temperature is reached.
Figure 14B:
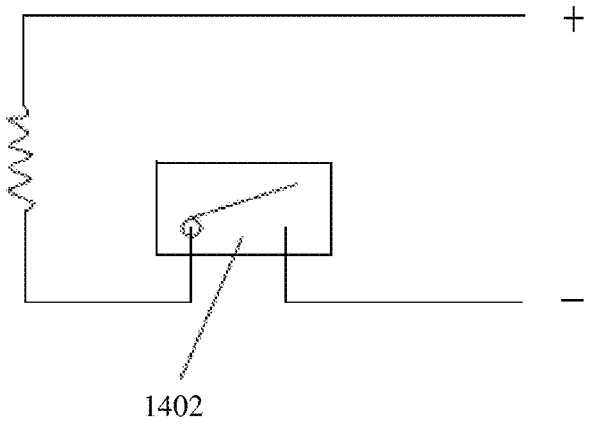
FIG. 14B shows an electric circuit diagram of FIG. 14A.

FIG. 13 shows by way of an example a safety box 1302 situated on top of the pole coupler 714 of the support assembly. Within this safety box 1302 is a thermocouple 1402 connected in series with a junction box 1404 as shown in FIG. 14A. FIG. 14B shows a circuit diagram that thermocouple 1402 is essentially a temperature activated switch. It is used as a safety device to shut off the heater head unit should the operating temperature of the heater head unit 110 or the safety box 1302 reaches a threshold dangerous level that could permanently damage the heater such as melting any components, wires or parts thereof.

Figure 15:
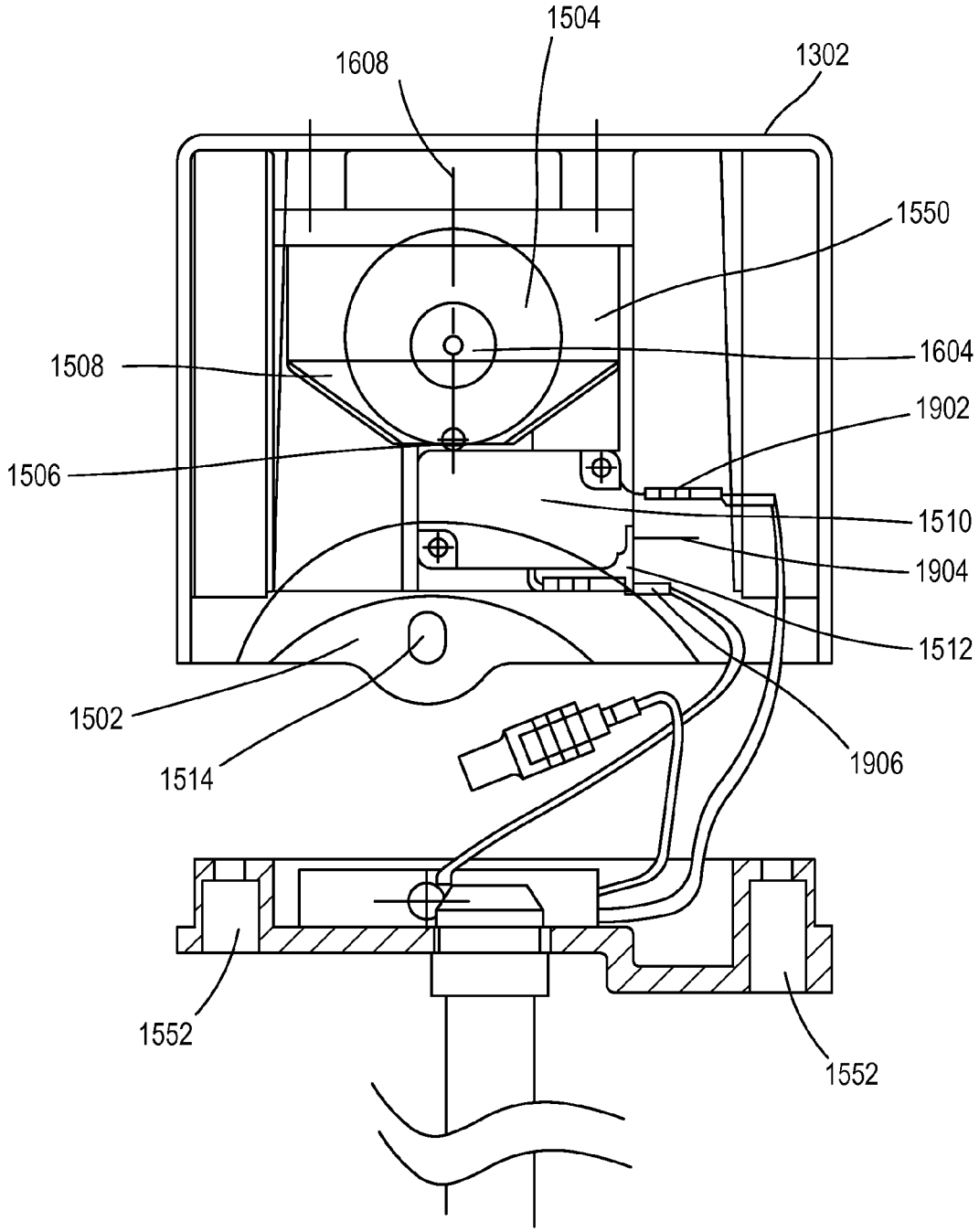
FIG. 15 illustrates a cross sectional view along a longitudinal direction of the safety box.
Figure 16:
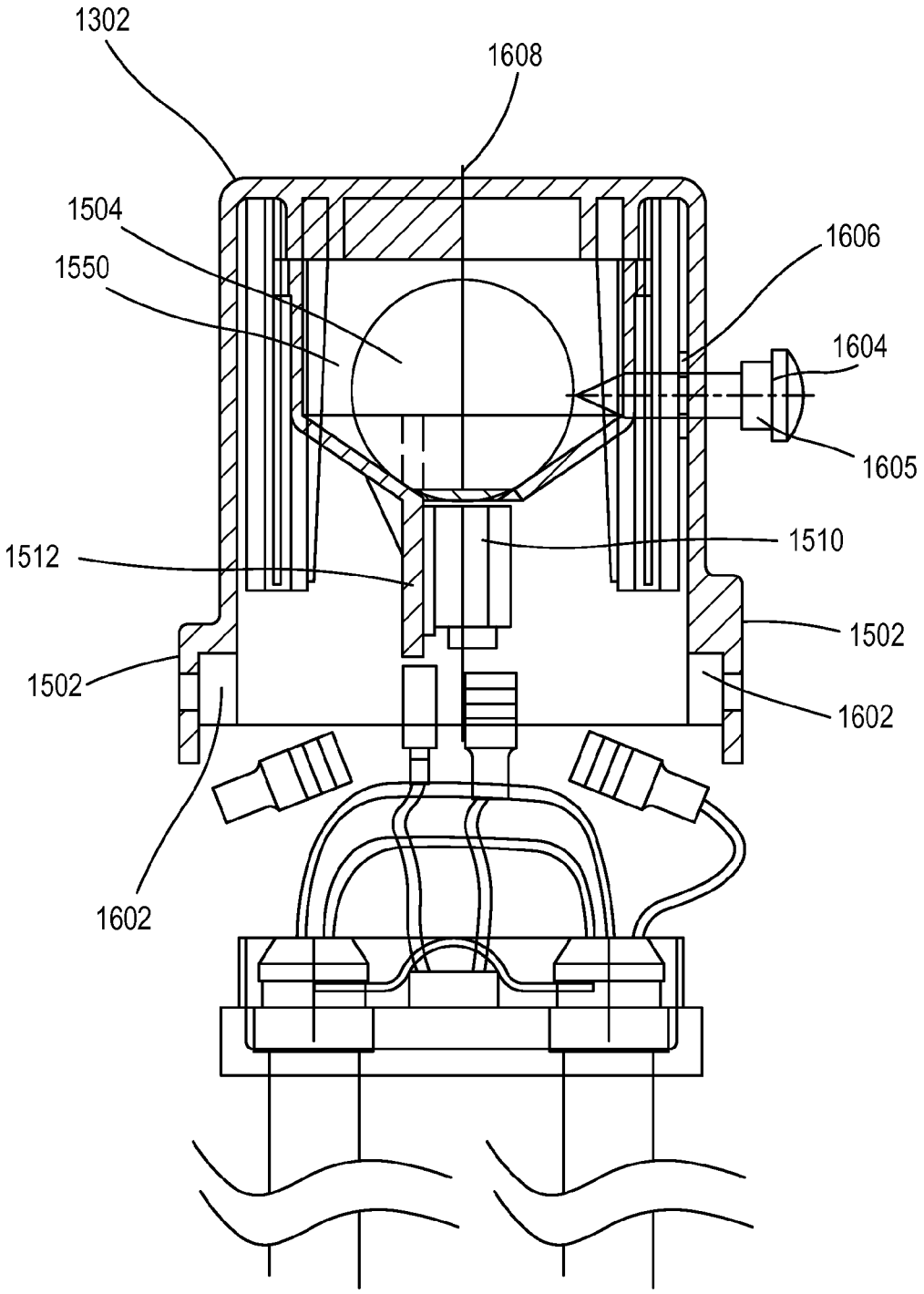
FIG. 16 illustrates a cross sectional view along a depth direction of the safety box of FIG. 15.

Alternatively, the safety box 1302 could also be a leveling switching mechanism a cross-sectional view of which along a longitudinal direction is shown by way of an example in FIG. 15 and a cross-sectional view of which along a depth direction is shown by way of an example in FIG. 16. The safety box 1302 is mounted on the pole coupler 714 along a curved engagement segment 1502 on both sides. The curved engagement segment 1502 has interior accommodation zones 1602 to house complimentary curved engagement segments 713 of the pole coupler 714. Degrees of curvature on the curved engagement segment 1502 and the curved engagement segments 713 of the pole coupler 714 are complementary. Once it is determined that the safety box 1302 is leveled thus substantially parallel to the floor, a fastener is tightened to the pole coupler 714 via hole 1514.

The purpose of the safety box 1302 is to cut-off electrical supply in case the heater unit toppled for whatever reasons thus could become a source of fire hazard. Cutting-off power supply of the toppled heater unit would effectively prevent any accidental fires from starting. Within the safety box is a ball bearing 1504. As the heater unit is standing upright, the weight of the ball bearing 1504 sits on top of a switch trigger 1506 making an electrical connection. The ball bearing 1504 is channeled by the interior chamber 1507 with the help of gravity pull to engage the switch trigger 1506. Upon sufficient tilting of the heater unit, the ball bearing 1506 affected by gravity would roll away from the center thus disengage the switch trigger 1506.

The angle that causes the engagement and disengagement of switch trigger 1506 is of critical importance. It cannot be so sensitive as to cause power disruption upon any minute detection of shaking such as due to blowing winds, accidental bumping into the heater unit during routine use, uneven floorboards any movements of which transmits vibration to the heater unit, etc. It also cannot be so insensitive that even in situations of a real danger, the level switching mechanism does not disrupt electrical power transmitted to the heater head unit 110. It is determined that a good angle to cutoff power supply should be substantially in a range between 30-40 degrees from a perfectly level horizontal position, as could be easily established by a bubble leveler. Anywhere between this range of angles should be safe. However, 34 degree is determined to be the ideal angle to ensure cutoff when needed and maintain power on when inconsequential random movements occurred.

In addition to turning on and off electrical connections as determined by the level switching mechanism, there are situations the heater head unit 110 should be manually turned off completely such as for over-night non-use. To implement a manual on/off mechanism, a push-in/pull-out mechanical push rod 1604 as shown by way of an example in FIG. 16 is used. Switch trigger 1506 is situated in the safety box 1302. Upon pushing the push rod 1604 into safety box 1302, the push rod physically pushes the ball bearing 1504 off-centered thus unable to engage switch trigger 1506. Hence, the heater could never be turned on. Conversely, upon pulling-out of the push rod 1604, the impediment to engage switch trigger 1506 would be removed thus allow ball-bearing 1504 to roll onto the switch trigger 1506, thus engage it to provide power to the heater head unit 110. Push rod 1604 is prevented from fully retrieved out of the safety box 1302 by the presence of a retaining clip 1606. Similarly, push rod 1604 could never be fully pushed too far by the presence of a stop buffer 1605.

Figure 17:
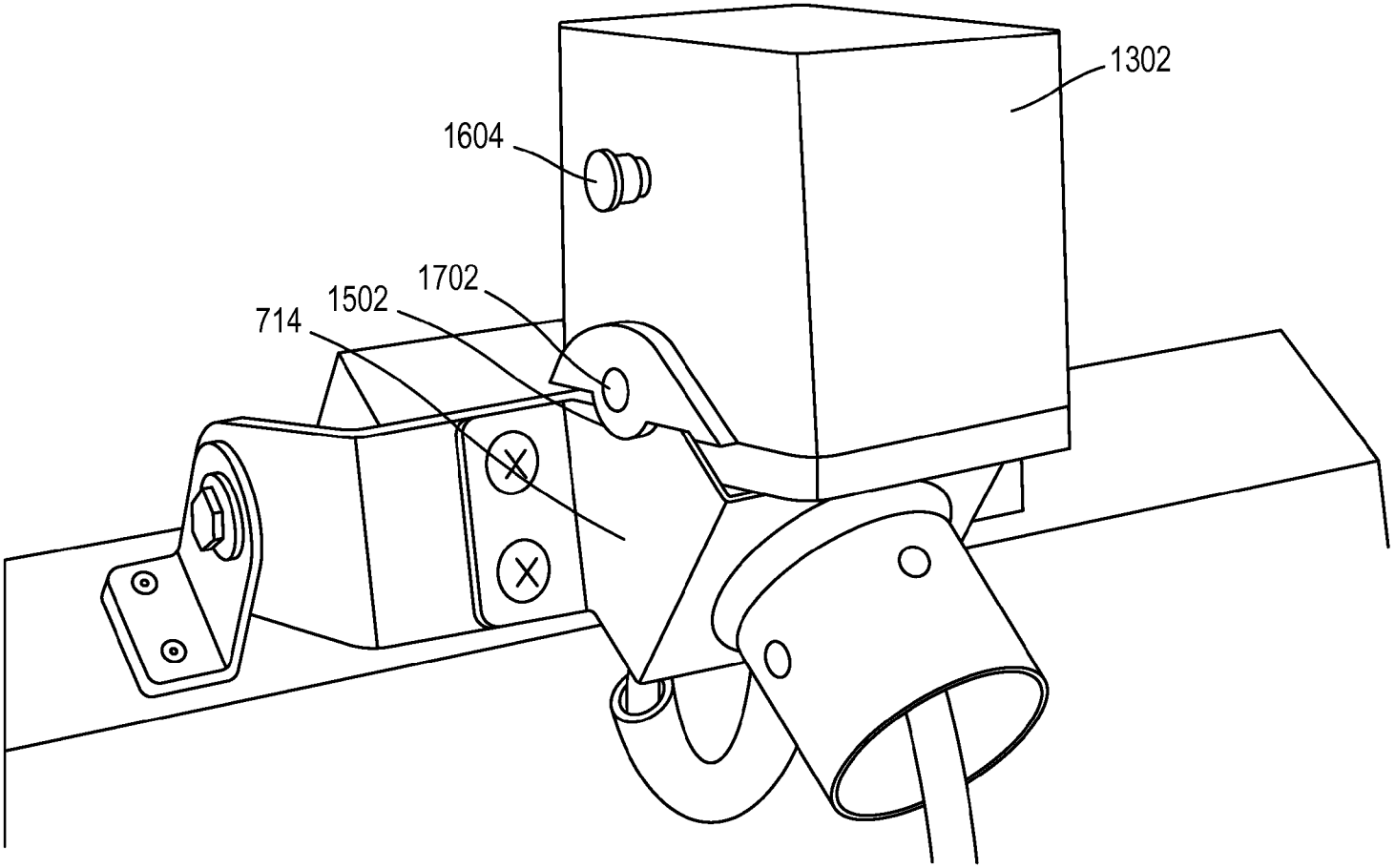
FIG. 17 illustrates how the safety box is mounted onto the heater head unit.

FIG. 17 shows a view of the safety box 1302 fully mounted onto a mount coupler 714. As can be visually verified, once the safety box 1302 is acceptably level and the interior accommodation zones 1602 sufficiently engage the house complimentary curved engagement segments 713 of the pole coupler 714, a fastener 1702 is transversely inserted into holes 1514 and tightened into a locked position.

Figure 18:
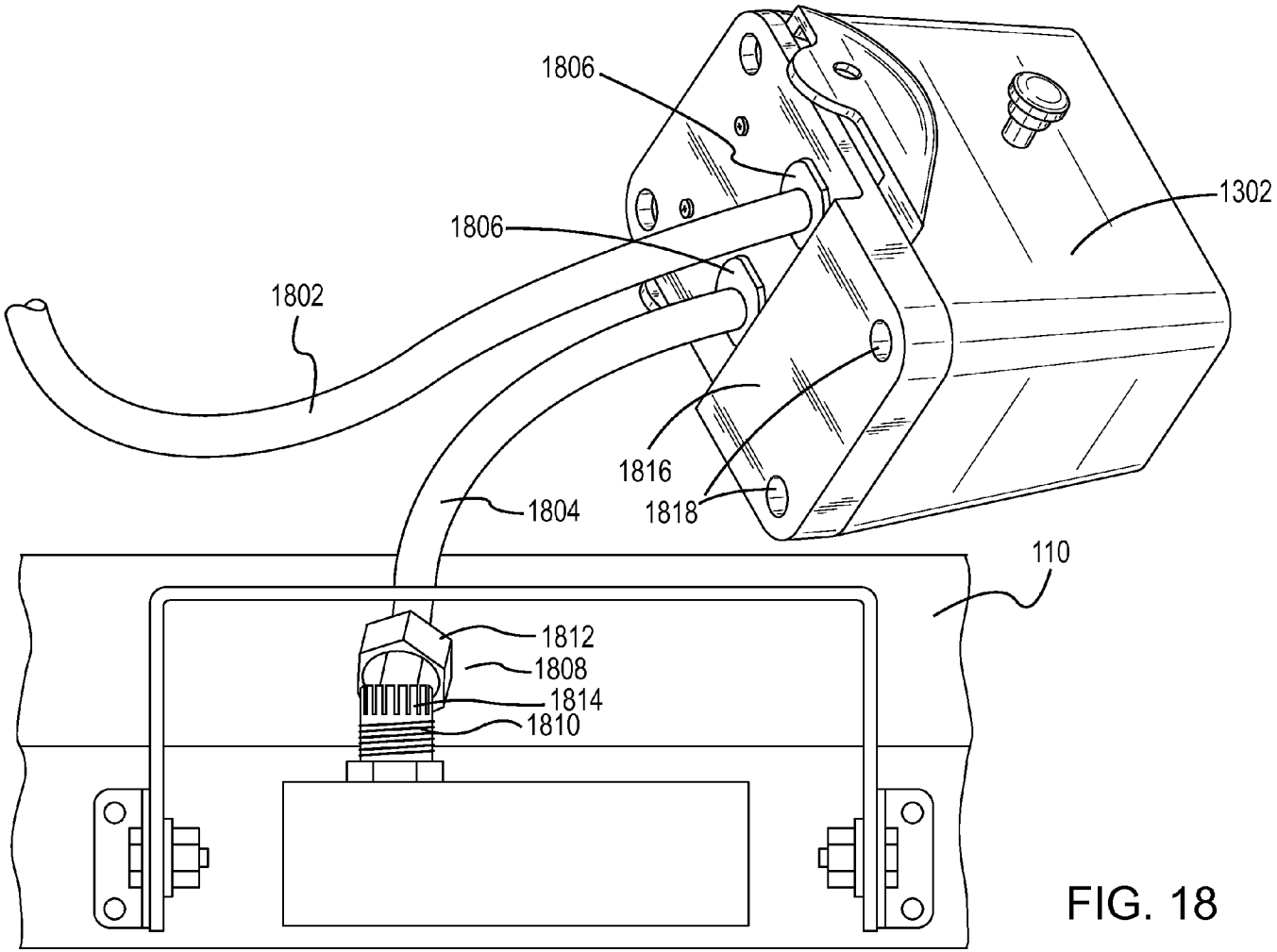
FIG. 18 illustrates how the safety box is electrically connected to the heater head unit.

FIG. 18 shows a safety box 1302 that is dismounted from the heater head unit 110. As shown, two electrical wires 1802 and 1804 are connected to the safety box 1302. Electrical wire 1802 is connected to a plug in power source. Electrical wire 1804 is connected to the heater head unit 110. Both electrical wires are secured to the safety box by through-hole buffers 1806, each buffer is tightly squeezed there-in-between each wire opening and associated wire to close any air gaps to prevent moisture infiltration into the safety box 1302. With the explanations given above, it should be apparent to a skilled person in the art that power source is transmitted from wire 1802 into safety box 1302, to wires 1804 and finally to heater head unit 110 via a moisture proof coupler 1808. Should the safety box 1302 tilt passed a predetermined angle away from a level horizontal position, switch trigger 1506 is disengaged, thus power to the heater head unit 110 is cut-off.

Coupler 1808 has a mount piece 1810 and a cap piece 1812. One end of mount piece 1810 is thread fitted into part of the heater head unit 110 and another end serves as a receptor for cap piece 1812. By the distal end of said receptor are collapsible columns 1814. As cap piece 1812 is tightened onto mount piece 1810, the collapsible columns 1814 are squeezed in-between wire 1804 and cap piece 1812 to ensure a secured fit and to prevent moisture from entering into the heater head unit 110.

Figure 19:
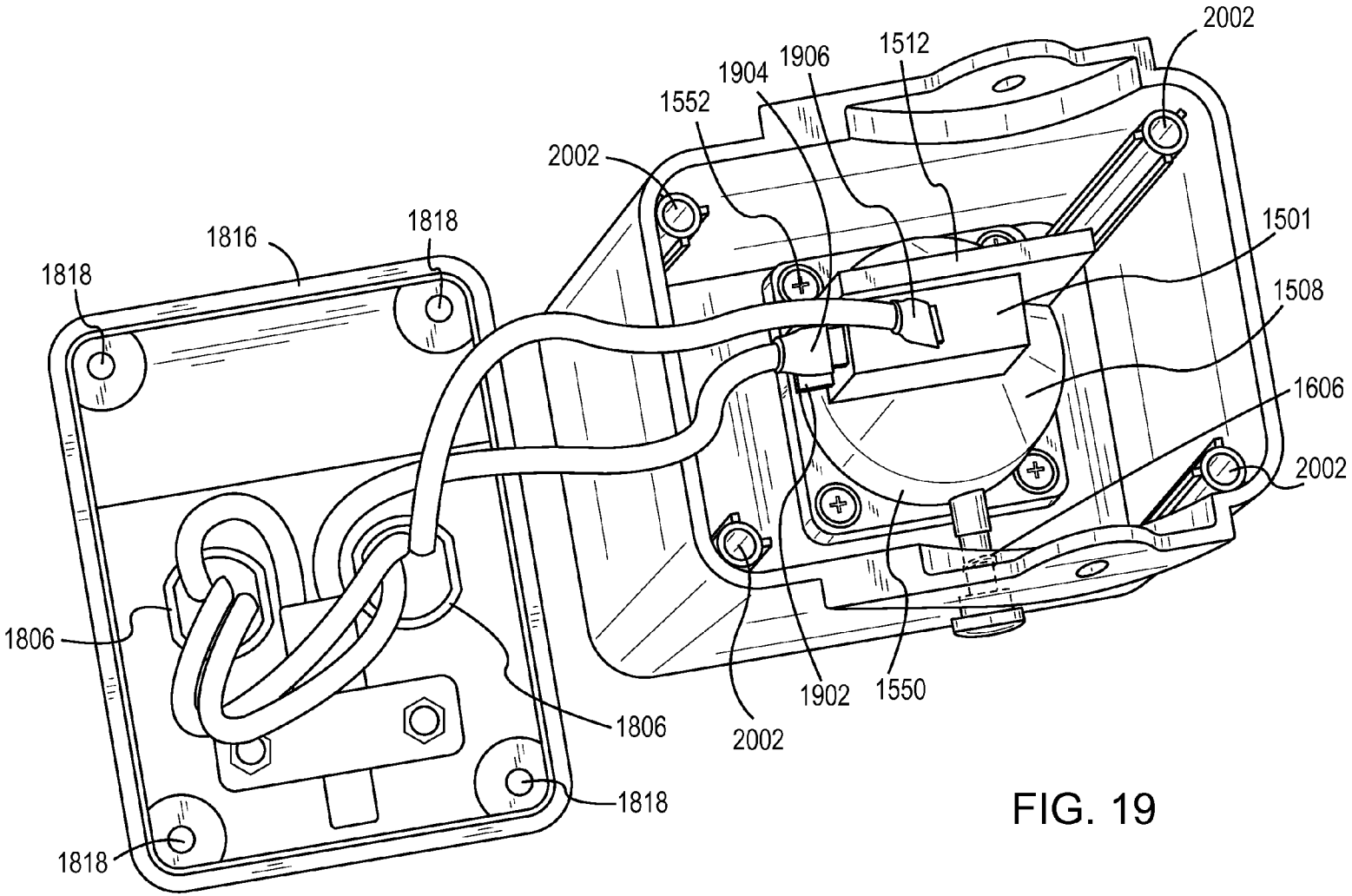
FIG. 19 illustrates a bottom interior view of the safety box of FIG. 15.
Figure 20:
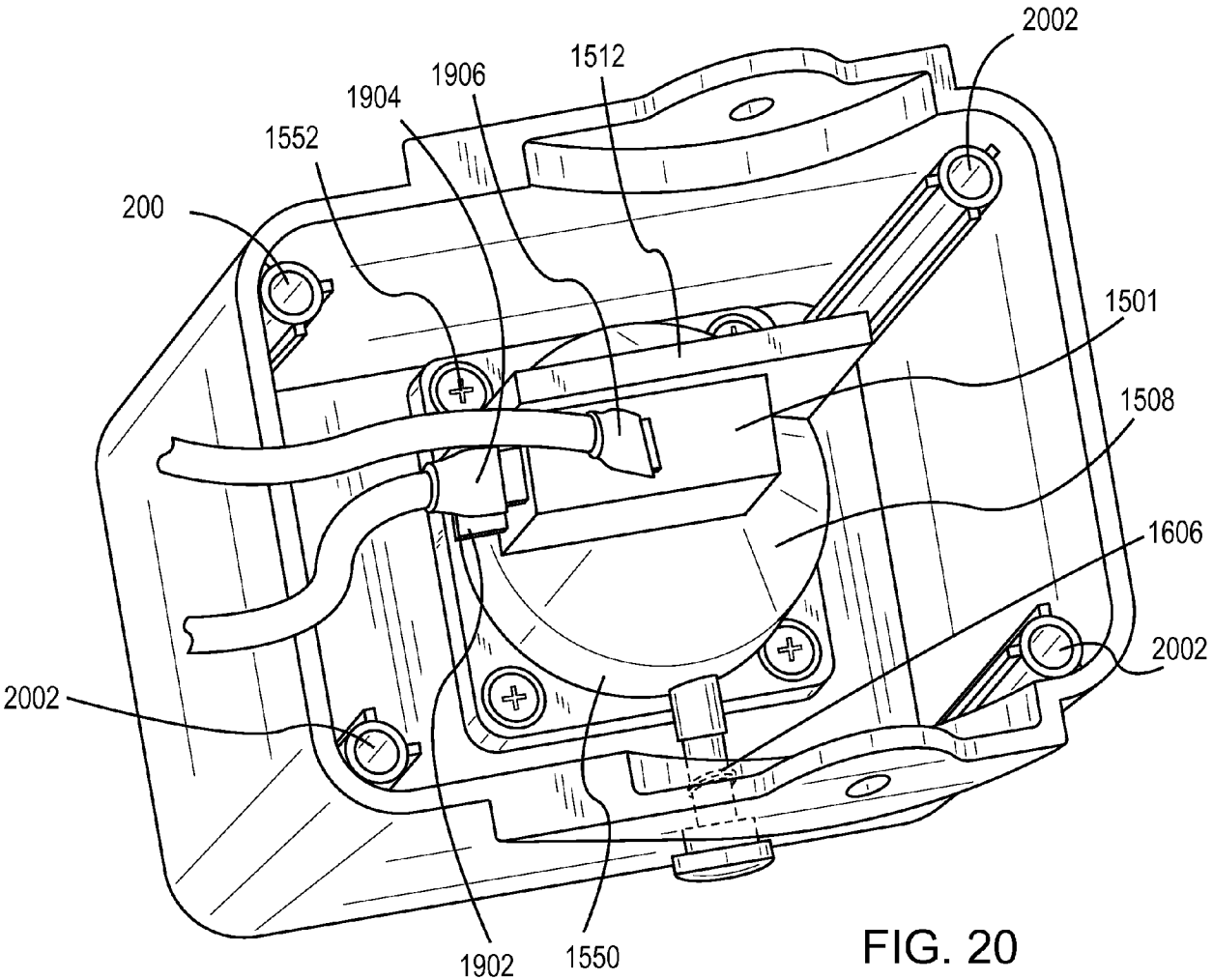
FIG. 20 illustrates another bottom interior view of the safety box of FIG. 15.
Figure 21:
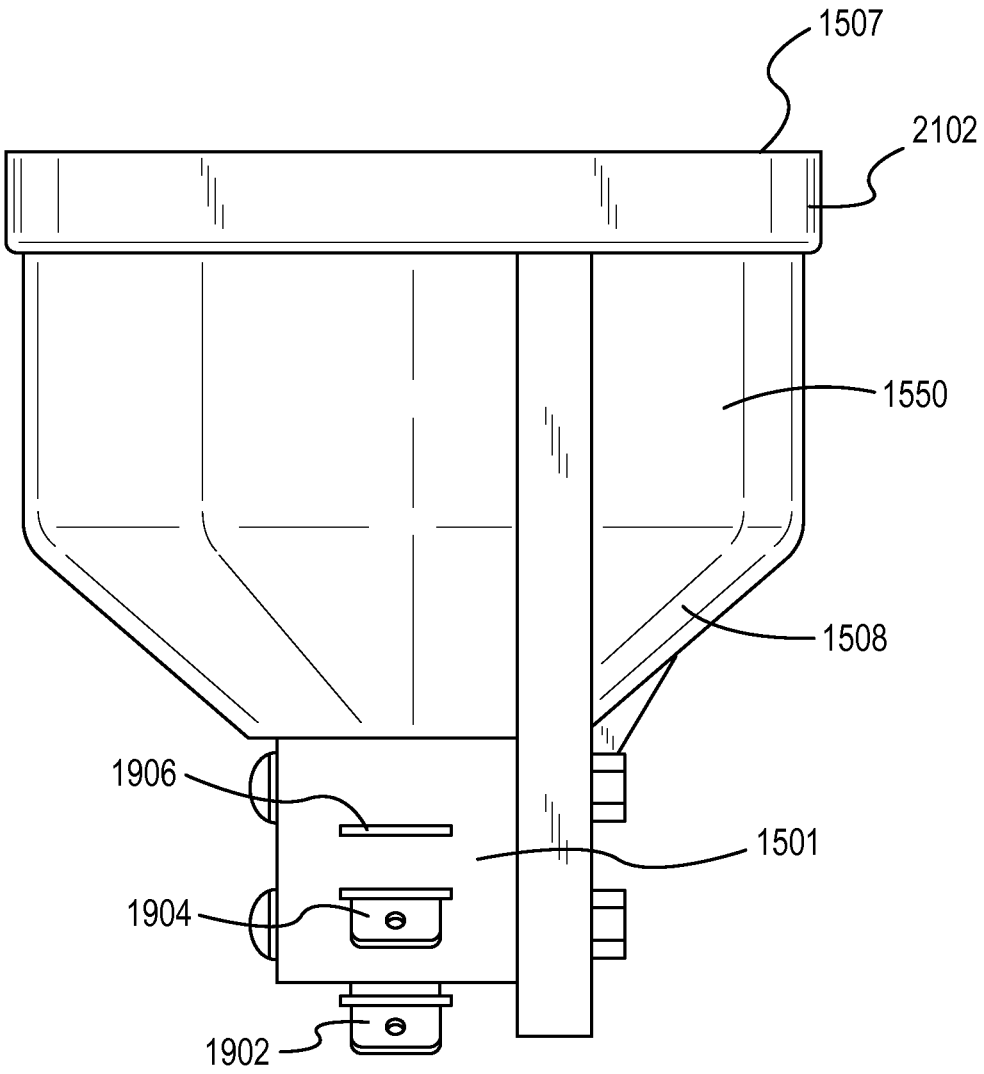
FIG. 21 illustrates a side view of an interior chamber with a vertical wall mounted thereon an electrical switch.
Figure 22:
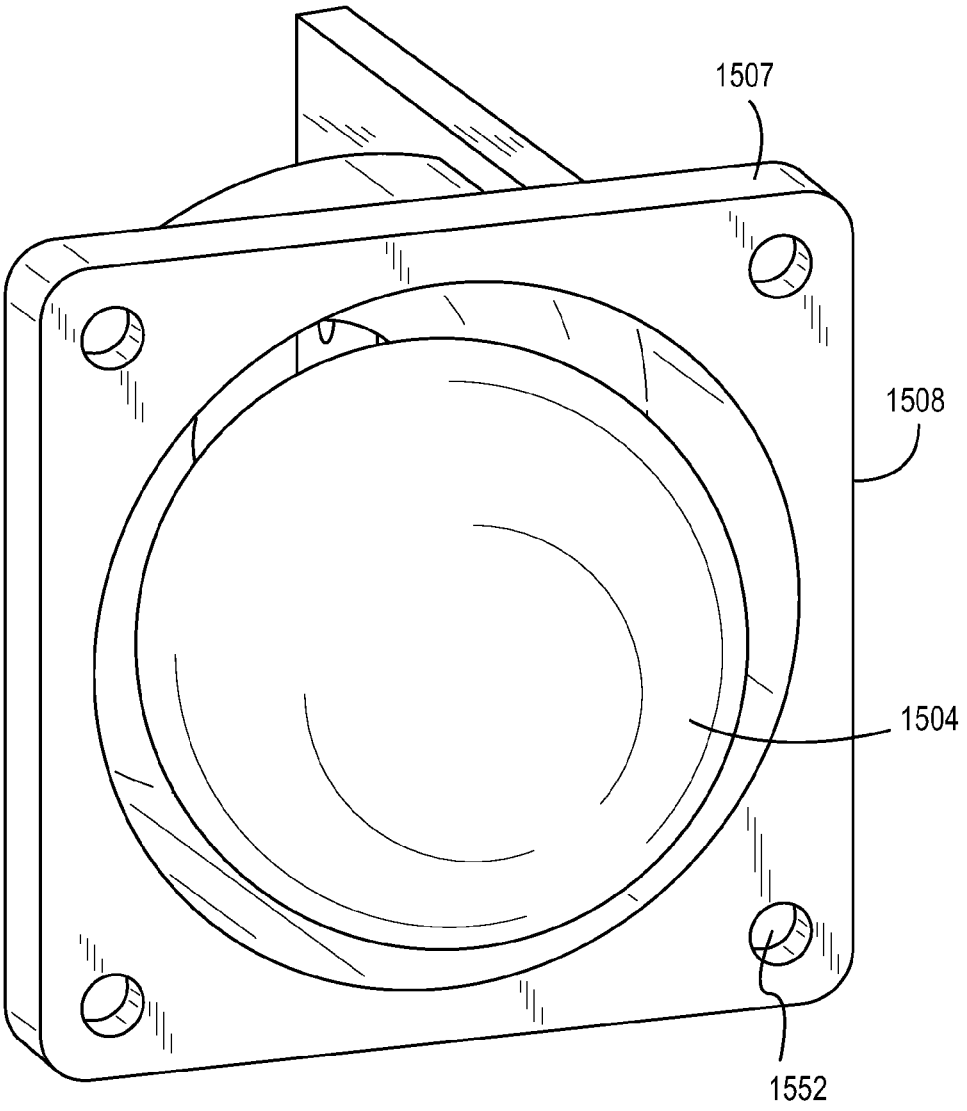
FIG. 22 illustrates a ball bearing inside the interior chamber.
Figure 23:
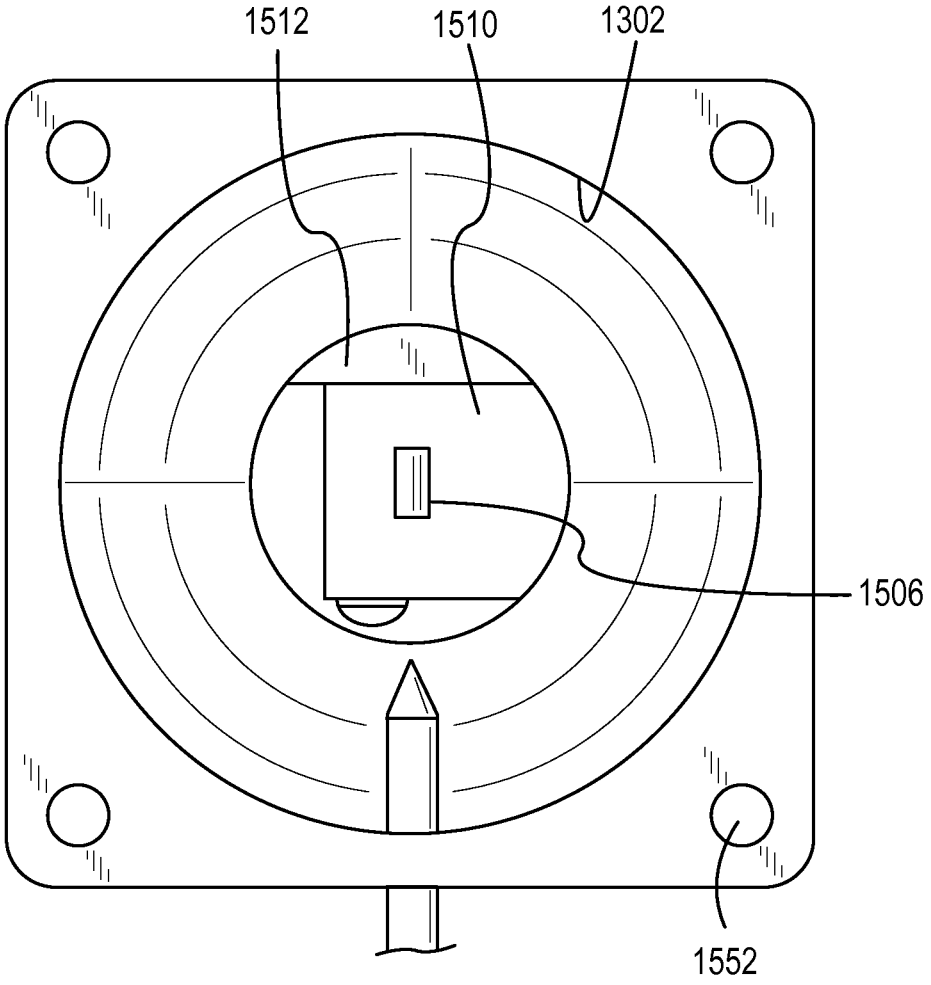
FIG. 23 illustrates a switch pin underneath an opening of the interior chamber.

FIGS. 19 and 20 show a bottom interior view of safety box 1302 and its cover 1816. A switch 1501 is mounted to wall mount 1512. As better shown in FIGS. 16 and 20, wall mount 1512 indeed is offset from a central axis 1608 of the cone or concave openings. This offset is mainly to ensure the switch trigger 1506 would be located on the bottom along the central axis 1608 of interior chamber 1508, as best shown in FIGS. 15 and 23. This is the perfect location for ball bearing 1504 to engage the switch trigger 1506, as shown in FIGS. 15, 19 and 22.

Switch 1501 has three terminals 1902, 1904 and 1906. Terminal 1906 is connected to wire 1802 leading to a power supply source and terminal 1904 is connected to wire 1814 leading to the heater head unit 110. Terminal 1902 is shown not connected to any wire. In effect, terminals 1902 and 1904 are two way switches, meaning that the power source from terminal 1906 is either supplied to terminals 1902 or 1904 at any moment in time. In this invention, when ball bearing 1504 engages switch trigger 1506, power from terminal 1906 is solely supplied to terminal 1904 which in turn is supplied to heater head unit 110. When the ball bearing 1504 disengages switch trigger 1506, power from terminal 1906 is solely supplied to terminal 1902 leaving the heater head unit 110 completely without power. Though not shown, terminal 1902 may be used for such optional features as 1) empowering a siren to alert end users that the heater has toppled and attention is needed, 2) activate a counter to determine the number of power interruptions to receive fore-warnings before the heater unit topples, or 3) use it as a trigger to cutoff the power source to wire 1802 as double security in case the heater is located in an environment where slopes exist and the toppled heater may by chance roll and bounce into an upright position again. By so cutoff the power source to wire 1802, even if the ball bearing 1504 engages switch trigger 1506 again, there would not be any power source for the heater head unit 110 until an operator resets the external power supply source. There are many more scenarios where terminal 1904 could provide optional features.

FIGS. 19 and 20 show a set of screw receiving stems 2002 located at four interior corners of the safety box. They are present to allow a cover 1816 with a set of through-holes 1818 located about its four interior corners to accommodate four fasteners to secure and seal the safety box 1302.

FIGS. 15, 16 and 20 show that the interior chamber 1507 has several segments. The first segment is the cone or concave segment 1508 without a closure end. The second segment is a cylinder segment 1550 that has a diameter substantially the same as the largest diameter of the cone or concave segment. While the cone or concave segment 1508 is used to channel the ball bearing 1504 to engage the switch trigger 1506, the cylinder segment 1550 is used to house the ball bearing 1504 in case the heater topples. The third segment is a mount segment 2102 that has an circular interior shape and a quadrilateral exterior shape. At interior corners between the circular shape and quadrilateral exterior shaped are a set of through-holes 1552. Underneath-holes 1552 and on the interior side of the safety box 1302 are a set of screw-receiving stems to receive a set of fasteners to secure the interior chamber 1507 thereto the safety box 1302.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The inventions defined solely by the appended claims including any amendments made during the pendency of this application and all equivalents of those claims as issued.

What is claimed is:

1. An adjustable electric heater with a safety controlled box, comprising:

a heater head with a pair of receiving taps;

a mounting bracket with a pair of legs rotatably and correspondingly mounted to the pair of receiving taps;

a support assembly with a pole coupler supported by a supporting floor is mounted to the mounting bracket to uphold the heater head to a predetermined height;

an angle limiter is formed on one of said pair of legs and said pair of receiving taps to provide a predetermined degree of rotational freedom to the heater head; and wherein the safety controlled box being mounted on the pole coupler.

2. The adjustable electric heater with the safety controlled box of claim 1, wherein the safety controlled box comprises a level activated switching mechanism.

3. The adjustable electric heater with the safety controlled box of claim 1, wherein the safety controlled box comprises a case housing, an interior chamber, a switch and a cover.

4. The adjustable electric heater with the safety controlled box of claim 3, wherein the case housing is quadrilateral in shape with a bottom opening.

5. The adjustable electric heater with the safety controlled box of claim 4, wherein on an interior upper side of the case housing comprises a set of screw receiving stems spaced equal distance apart from each other.

6. The adjustable electric heater with the safety controlled box of claim 4, wherein a set of house screw-receiving stems being located at interior corners of the case housing.

7. The adjustable electric heater with the safety controlled box of claim 1, wherein the interior chamber comprises one of a conical shaped segment and a concave shaped segment without a closure end yielding a small opening with a smallest diameter on a lower end and a large opening with a largest diameter on an upper end where a first concentric axis is located along a number of mid-points of the smallest diameter and the largest diameter.

8. The adjustable electric heater with the safety controlled box of claim 7, wherein the interior chamber comprises a vertical wall located below said one of the conical shaped segment and the concaved shaped segment, and wherein the vertical wall is located offset from the first concentric axis.

9. The adjustable electric heater with the safety controlled box of claim 8, wherein one side of the vertical wall protrudes into an edge portion and beneath the small opening wherein a portion of said one side of the wall is removed.

10. The adjustable electric heater with the safety controlled box of claim 8, wherein the switch for making one of connection and disconnection being mounted on the vertical wall.

11. The adjustable electric heater with the safety controlled box of claim 10, further comprises a ball bearing placed inside said one of the conical shaped segment and concave shaped segment of the interior chamber.

12. The adjustable electric heater with the safety controlled box of claim 11, wherein an upper end of said one of the conical shaped segment and concave shaped segment of the interior chamber transitions into a cylindrical segment sharing the first concentric axis.

13. The adjustable electric heater with the safety controlled box of claim 12, wherein an upper end of the cylindrical segment of the interior chamber transitions into a mount segment with an exterior quadrilateral shape and an interior circular shape sharing the first concentric axis.

14. The adjustable electric heater with the safety controlled box of claim 13, wherein a set of through-holes is located at each inside corner of the quadrilateral shape of the mount segment.

15. The adjustable electric heater with the safety controlled box of claim 10, wherein a switch trigger is located at an upper end of the switch.

16. The adjustable electric heater with the safety controlled box of claim 15, wherein the switch trigger is located along the first concentric axis.

17. The adjustable electric heater with the safety controlled box of claim 16, wherein the switch trigger is engaged as the ball bearing is gravity pulled onto a lowest position of the interior chamber and comes in contact with the switch trigger.

18. The adjustable electric heater with the safety controlled box of claim 17, wherein the switch has a first terminal, a second terminal and a third terminal.

19. The adjustable electric heater with the safety controlled box of claim 18, wherein the first terminal is connected to an incoming electrical power line.

20. The adjustable electric heater with the safety controlled box of claim 19, wherein the switch trigger engages one of the second terminal and the third terminal.

21. The adjustable electric heater with the safety controlled box of claim 20, wherein one of the second terminal and the third terminal is connected to an outgoing electrical line.

22. The adjustable electric heater with the safety controlled box of claim 21, wherein when the ball bearing engages the switch trigger, the incoming electrical power source is transmitted to one of the second terminal and the third terminal.

23. The electrical safety device with the safety controlled box of claim 22, wherein the bottom opening of the housing comprises a pair of curved flanges with a pair of curved upper engaging portions and a pair of outer engaging portions.

24. The electrical safety device with the safety controlled box of claim 17, wherein the pair of upper engaging portions is removably rested on a pair of complimentary curved engaging portions on the pole coupler.

25. The electrical safety device with the safety controlled box of claim 18, wherein a fastener is transversely inserted into a pair of holes on the outer engaging portions and a pair of engaging holes of the pole coupler.

26. The electrical safety device with the safety controlled box of claim 18, wherein the fastener is tightened to frictionally secure the electrical safety controlled box onto the pole coupler.

27. The electrical safety device with the safety controlled box of claim 1, wherein a chamber hole is located on the interior chamber and a house hole is located on the housing wherein both the chamber hole and the house hole share a second concentric axis.

28. The electrical safety device with the safety controlled box of claim 27, wherein a push-rod having a tip end and a butted end with a circular groove there-in-between being inserted along the second concentric axis into the chamber hole and the house hole.

29. The electrical safety device with the safety controlled box of claim 28, wherein a retainer clip is transversely inserted into the circular groove of the push-rod in a space inside the housing and outside the interior chamber to retain the push-rod therein the chamber hole and the house hole.

30. The electrical safety device with the safety controlled box of claim 29, wherein upon pushing of the push-rod into the housing and interior chamber, the tip end pushes the ball bearing off center within said one of the conical shaped segment and concaved segment of the interior chamber to prevent the ball bearing from rolling into a lowest position of the interior chamber to engage the switch trigger.

31. The electrical safety device with the safety controlled box of claim 30, wherein upon pulling of the push-rod from the housing, the tip end no longer engages the ball bearing within said one of the conical shaped segment and concave segment of the interior chamber allowing the ball to roll into the lowest position of the interior chamber to engage the switch trigger.

32. The electrical safety device with the safety controlled box of claim 1, wherein a set of house screw-receiving stems being located at a set of interior corners of the housing.

33. The electrical safety device with the safety controlled box of claim 31, further comprises a cover in quadrilateral shape with a set of cover through-holes at each interior corner of the cover.

34. The electrical safety device with the safety controlled box of claim 33, wherein the cover comprises a number of holes respectively allowing the incoming electrical line and the outgoing electrical line to pass there-through.

35. The electrical safety device with the safety controlled box of claim 33, wherein a set of screws insertably secured the cover to the housing via the set of house screw-receiving stems and the set of cover through-holes.

* * * * *